United States Patent [19]

Schlicht

[11] 4,169,801

[45] Oct. 2, 1979

[54] AMINE DERIVATIVES OF LACTAM ACID AND THEIR USE AS LUBRICATING OIL DISPERSANTS

[75] Inventor: Raymond C. Schlicht, Fishkill, N.Y.

[73] Assignee: Texaco Inc., White Plains, N.Y.

[21] Appl. No.: 865,108

[22] Filed: Dec. 27, 1977

[51] Int. Cl.[2] ..... C10M 1/32

[52] U.S. Cl. ..... 252/51.5 A; 260/326.45; 544/335; 548/348

[58] Field of Search ..... 252/51.5 A, 51.5 R, 252/390; 260/326.45; 544/335; 548/348

[56] References Cited

U.S. PATENT DOCUMENTS

| | | | |
|---|---|---|---|
| 3,062,631 | 11/1962 | Thompson | 252/51.5 R X |
| 3,138,610 | 6/1964 | Buc et al. | 548/348 |
| 3,224,968 | 12/1965 | Hinkamp | 260/326.45 X |
| 3,415,750 | 12/1968 | Anzenberger | 548/348 |

*Primary Examiner*—Delbert E. Gantz
*Assistant Examiner*—Andrew Metz
*Attorney, Agent, or Firm*—Thomas H. Whaley; Carl G. Ries; James J. O'Loughlin

[57] ABSTRACT

This invention is directed to amide, dihydroimidazolinyl, and tetrahydropyrimidyl derivatives of gamma lactam acids prepared by reaction of gamma lactam carboxylic acids with a variety of polyamines.

63 Claims, No Drawings

AMINE DERIVATIVES OF LACTAM ACID AND THEIR USE AS LUBRICATING OIL DISPERSANTS

BACKGROUND OF THE INVENTION:

This invention relates to lactam amides and lactam dihydroimidazolines and tetrahydropyrimidines also characterized as amido-, dihydro-imidazolinyl-and tetrahydropyrimidylsubstituted tetrahydropyrrolidones or butyrolactams and to their preparation by reaction of a gamma lactam carboxylic acid with a polyamine. The resulting products provide useful dispersants for incorporation in lubricant oil compositions.

The reaction of lactone acetic acid with polyamines to produce the corresponding lactam acid salts and amides useful as lubricant additives is described in U.S. Pat. No. 3,925,232. The lactone acetic acid reactants of the foregoing patent are prepared by hydrolysis of hydrocarbyl, and preferably alkenyl, succinic anhydride.

The reaction of an alkenyl succinic acid or anhydride with an ethylene polyamine to produce a useful dispersant for incorporation in lubricant oil compositions is also well-known and described in U.S. Pat. No. 3,172,892.

Further, it has been proposed in U.S. Pat. No. 3,808,131 to produce lubricant additives by reaction of an alkylene polyamine, monocarboxylic acid or its anhydride and, sequentially, an alkenyl succinic acid or its anhydride, in turn, and a metal salt.

If, however, novel lactam acid amides and particularly lactam acid dihydroimidazolines and tetrahydroyrimidines having significant utility as dispersants in combination with effective corrosion inhibition properties for use in lubricant compositions to be incorporated in fuels, automatic transmission fluids, diesel engines, outboard motors, and the like, could be conveniently and readily prepared, using gamma-lactam carboxylic acids in reaction with a variety of amines, and particularly, polyamines, a significant advance in the state of the art would be effected.

SUMMARY OF THE INVENTION:

It is an object of the invention, therefore, to provide novel lactam amides and, more particularly, novel tetrahydropyrimidyl-and dihydroimidazolinyl-substituted lactams.

It is a further object of this invention to produce these compounds by novel and convenient methods resulting in high yields of the desired products.

These and other objects and advantages of this invention will become evident from the following description.

Accordingly, it has been discovered that amido-and polyamino heterocyclic-substituted, butyrolactams and particularly, 3-dihydroimidazolin-2'yl-butyrolactams, can be conveniently prepared by reaction of a lactam carboxylic acid, or more precisely a 2-or 3-hydrocarbyl-3-carboxy-butyrolactam with an amide, and, more specifically, an alkylenediamine or polyalkylene polyamine.

DETAILED DESCRIPTION OF THE INVENTION:

The amide and polyheterocyclic nitrogencontaining derivatives of lactam carboxylic acids prepared in accordance with the invention are characterized by the formula:

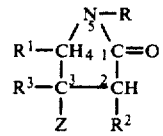

(I)

wherein Z is a nitrogen-containing moiety of the formulae:

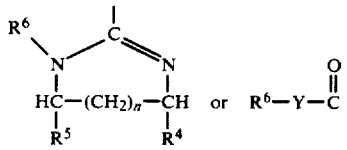

where, in the foregoing formulae, R is a hydrocarbyl radical, including an alkyl, aryl, alkaryl or aralkyl radical, or a mono-or di-substituted aminoalkyl radical wherein said alkyl moieties contain from 1 to 12, and preferably 1 to 7, carbon atoms; R is, most desirably, a lower alkyl radical of from 1 to 7 carbon atoms, or an N-butyrolactam alkyl radical in which said alkyl moiety contains from 1 to 12, and preferably 2 to 6, carbon atoms, and said lactam radical contains, in addition, the substituents $R^1$, $R^2$ and $R^3$ having the values provided herein; $R^1$ is a hydrogen atom or a hydrocarbyl radical and desirably one of from 1 to 20 carbon atoms, including an alkyl, aryl, aralkyl or alkaryl radical and preferably a phenyl radical; each of $R^2$ and $R^3$ is a hydrogen atom or a hydrocarbyl radical of from 1 to 500 carbon atoms, and preferably an alkenyl radical of from 10 to 500, and most desirably 10 to 300 carbon atoms, provided that only one of $R^2$ and $R^3$ is hydrogen and only one a hydrocarbyl radical; n has a value of from 0 to 1 inclusive, each of $R^4$ and $R^5$ is preferably a hydrogen atom or, if desired, a hydrocarbyl radical, illustratively, of from 1 to 25 carbon atoms, that is, an alkyl, aryl, alkaryl or aralkyl radical; and $R^6$ is any of the radicals represented by each of $R^4$ and $R^5$ or, and indeed preferably, hydrogen or an aminoalkyl or polyazaalkyl radical of the formula:

$$-(C_mH_{2m}NH)_pH$$

wherein m has a value of from 1 to 6 (and preferably 2 to 6); and p has a value of from 1 to 10; and Y is an ethylene or propylene dimino radial having the structure $-NH(C_bH_{2b})NH$,-wherein b is an integer of from 1 to 3 inclusive. The foregoing radicals characterized as "hydrocarbyl" are intended to include one or more substituents from which active hydrogen atoms are absent; including alkoxyl, nitro, nitrile, carboalkoxy, and tertiary amino (and particularly dimethylamino) moieties; and which are, with respect to those of the foregoing moieties occurring as substituents in the radicals represented by R,$R^1$, $R^2$ and $R_3$, less reactive, in any event, than an imino.

The amido-lactams coming within the scope of the present invention provide desirable dispersants for lubricant oil compositions and are also intermediates in the the production of the preferred diazole and diazine-substituted lactams of the invention. The conversion from the amide to the imidazoline occurs upon conducting the condensation reaction, described hereinafter, to completion.

The foregoing products of the invention are prepared by reaction of a lactam carboxylic acid or carboxybutyrolactam, as also characterized herein, such as produced in the copending application of the applicant herein filed on even date herewith and entitled "Lactam Carboxylic Acids, Their Method of Preparation and Use" and incorporated by reference herein.

The lactam carboxylic acids or 3-carboxybutyrolactams employed herein are thus characterized by the formula:

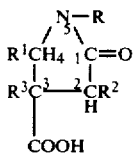

(II)

wherein each of R, $R^1$, $R^2$ and $R^3$ has the value assigned hereinabove, and are, in order to produce the amine derivatives of the invention, reacted with an alkylene, or an alkylene diamine or polyalkylene polyamine of the general formula:

(III) $H(NHC_rH_{2r})_qNH—(W)$ wherein W is a hydrocarbyl radical or preferably an aminoalkyl or polyazalkyl moiety of the formula:

$—(C_mH_{2m}NH)_pH$ and m is an integer of from 1 to 6 and preferably 2 to 6; r is an integer of from 2 to 3 inclusive, p has a value of from 0 to 10; and q is an integer of from 1 to 10; the sum of p and q not exceeding a value of 10.

The reaction of carboxybutyrolactam (or lactam carboxylic acid) and polyamine takes place at a temperature in the range of 0° C. to 250° C., desirably within the range of 60° to 200° C., and preferably at 100° C. to 180° C.; optionally, in the presence of an inert organic solvent such as benzene, hexane, heptane, octane, isooctane, toluene, xylene or other inert solvents and, most desirably, in an inert atmosphere and at ambient pressure. The amidesubstituted lactams are formed as intermediates when one mol of water is evolved for each carboxylic acid moeity present in the butyrolactam or lactam carboxylic acid of the reaction mixture. A yield of two mols of water for each mol of reactant lactam carboxylic acid indicates that the reaction has gone to completion.

The significantly preferred products of the present invention are those of the general formula:

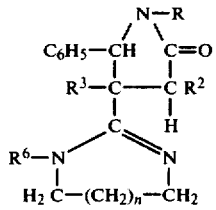

(V)

wherein R is a lower alkyl (and most desirably, methyl), an N,N-dialkylaminoalkyl moiety, wherein the alkyl moieties are lower alkyl or a N-[3-(dihydroimidazolin-2'yl)-4-phenyl] butyrolactam alkyl moiety containing an alkenyl radical of from 10 to 300 carbon atoms in the 2-carbon or 3-carbon position of the lactam ring; and $R^6$ in the polyamino heterocyclic ring is hydrogen or a moiety of the formula:

$—(C_mH_{2m}NH)_kH$ wherein m has the value assigned above and k is an integer of from 1 to 3 inclusive.

These preferred products are prepared from the appropriate corresponding lactam acids and polyamines, as described herein.

Illustrative of the preferred products coming within the purview of this invention are 3-polybutenyl-3-dihydroimidazolin-2'-yl-4-phenyl-5-methyl butyrolactam; 3-dodecenyl-3-dihydroimidazolin-2'-yl-4-phenyl-5-methyl butyrolactam; 2-dodecenyl-3-dihydroimindazolin-2'-yl-4-phenyl-5-methyl butyrolactam; 3-octadecyl 3-tetrahydropyrimdim-2'-yl-4-phenyl-5-methyl butyrolactam; ethylene bis-(2-polybutenyl-3-tetrahydropyrimidin-2'-yl-4-phenyl) butyrolactam 3-dodecenyl-3-tetrahydropyrimidin-2'-yl-4-phenyl-5-methyl butyrolactam; and isomeric mixtures thereof.

Lactam acids reactants for use in preparing the products of the invention are, illustratively, 2-polybutenyl-3-carboxy-4-phenyl-5-methyl butyrolactam; 3-dodecenyl-3-carboxy-4-phenyl-5-methyl butyrolactam; 2-dodecenyl-3-carboxy-4phenyl-5-methyl butyrolactam; 3-polybutenyl-3-carboxy-4-phenyl-5-methyl butyrolactum; 2-polyisobutenyl-3-carboxy-4-phenyl-5-(N',N'-dimethylaminoethyl) butyrolactam; 2-octadecenyl-3-carboxy-4-phenyl-5-(N',N'-dimethylaminoethyl) butyrolactam; 1',2'-ethylene-bis-(3-polybutenyl-3-carboxy-4-phenyl butyrolactam-5); 1',6'-hexylene-bis-(2-dodecenyl-3-carboxy-4-phenyl butyrolactam-5); 1',6'-hexylene-bis-(2-polybutenyl-3-carboxy-4-phenyl butyrolactam-5); and isomeric mixtures thereof. The polybutenyl and polyisobutenyl substituents referred to throughout this specification refer to alkenyl groups having average molecular weights of about 1000 to 1500, for example, 1290, and about 70 to 75 carbon atoms.

The polyamines for use herein include, illustratively, ethylene diamine, diethylene triamine, tetraethylene pentamine and propylene diamine.

The polyamine and lactam acid are reacted in a mole ratio of 1 mole of polyamine for each lactam acid moiety present. Thus, 1 mole of amine is utilized preferably in reaction with each ½ mole of bis-lactam carboxylic acid; whereas 1 mole of amine will suffice for each mole of lactam acid containing a single carboxyl group. The foregoing molar relationships are intended to describe the least amount of polyamine that will react with all of the lactam carboxylic acid added to the reaction. Lesser amounts, and indeed, molar amounts in excess of those recited can also be employed.

The desired diazole (imidazole) and diazine (pyrimidine) products are conveniently separated from the intermediate amides, solvent where present, unreacted starting compounds and water of reaction by conventional means including refluxing for removal of water and excess polyamine, cooling, filtration and vacuum stripping leaving only, at least in some cases, an isomeric mixture of the desired lactams products containing an alkenyl (or other appropriate) substituent in the 2-carbon and 3-carbon positions of the lactam nucleus. The amide intermediates described herein as well as the dihydro imidazolinyl and tetrahydroyrimidyl lactam products of the invention have utility as corrosion inhibitors and dispersants for use in lubricant oil compositions to be employed in automatic transmission fluids, diesel engines, outboard engines and the like. As surfactants they are particularly useful dispersants and anti-icing agents, as well as rust and corrosion inhibitors, in fuel. The unexpected application of selected compounds of those described herein as fuel additives appears in detail in the copending application of the applicant herein and another filed on even date herewith and entitled "Polyamine Derivatives of Alkenyl Lactam Carboxylic Acids as Fuel Additives" and incorporated by reference herein.

The butyrolactams of the invention, useful in lubricant oil compositions for use application in automatic transmissions, crankcase lubricant compositions and the like as otherwise indicated hereinabove, normally constitute a substantial or major portion by weight of any lubricant composition of which they form a part.

A desirable lubricant composition incorporating the additives of the invention and useful as a fully formulated crankcase oil is one containing about wihin about 0.1 percent to 10 percent of the butyrolactams of the present invention. This range, in the formulation of lube oil concentrates may be from about 10 percent to 50 percent. (Percentages referred to throughout this specification are intended to have reference to percentages by weight unless otherwise expressly indicted).

The lubricant compositions of the invention are also fortified normally with conventional additives such as anti-foaming agents, dispersants, antioxidants, pour point depressants, viscosity index improvers and the like.

A suitable anti-foaming agent is a dimethyl silicone polymer having a kinematic viscosity at 25° C. of about 100 centistokes and above. A very satisfactory anti-foaming agent for this purpose is prepared by diluting 10 grams of a dimethyl silicone polymer (1000 centistokes at 25° C.) with kerosene to provide a solution of 100 cubic centimeters. From 0.005 to 0.25 percent by weight of this concentrate is generally employed to provide from 50 to 200 parts per million of the silicone polymer based on the lubricating oil composition.

A metal, and desirably, a zinc dithiophosphate component desirably incorporated in the lubricating oil of the invention is one represented by the formula:

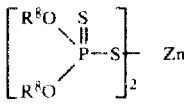

in which $R^8$ is a hydrocarbyl radical or a hydroxy-substituted hydrocarbyl radical having from 2 to 12 carbon atoms. The preferred zinc dithiophosphates are those in which R represents an alkyl radical having from 3 to 9 carbon atoms. Examples of suitable compounds include zinc isobutyl 2-ethylhexyl dithiphosphate, zinc di(2-ethylhexyl) dithiophosphate, zinc isoamyl 2-ethylhexyl dithiophosphate, zinc di(phenoxyethyl) diethiophosphate,zinc di(2,4 diethylphenoxyethyl) dithiophosphate and zinc isopropylmethyl isobutyl carbinyl dithiophosphate. In general, these compounds are employed in the oil composition in a concentration ranging from about 0.1 to 3.0 percent with the preferred concentration ranging from about 0.15 to 1.5 percent. These compounds can be prepared from the reaction of a suitable alcohol or mixture of alcohols with phosphorus pentasulfide. They are illustrated in U.S. Pat. Nos. 2,344,395 and 3,293,181.

Most desirable is the zinc alkyldithiophosphate prepared by reaction of 2.7 moles of a mixture of predominantly, that is up to 95 percent of $C_4$ to $C_9$ alcohols and 2-3 moles of isopropanol with 1.0 mole of $P_2S_5$. The zinc salt is then made by reaction of the dialkyldithiophosphoric acid with an excess of zinc oxide.

Ashless dispersants, the hydrocarbyl thiophosphonates represented by the formula:

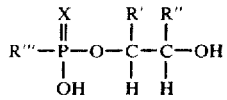

in which R''' is a hydrocarbyl radical having at least 12 carbon atoms and R' and R'' are selected from the group consisting of hydrogen and monovalent aliphatic hydrocarbyl radicals containing 1 to 6 carbon atoms, and X is predominantly, or normally, sulfur, may also be included in the lubricant compositions of the invention in amounts of 0.1 to 5 weight percent. However, preferred dispersants of this type, optionally employed herein, in the same concentrations are mono β-hydroethyl) alkene thiophosphonates, and, most desirably, those wherein the alkene substituent is polybutene (of an average molecular weight of about 1000 to 1500, i.e. 1290).

Used to provide a high level of alkalinity in the lubricant oil composition of the invention is a calcium carbonate overbased calcium sulfonate component containing from about 5 moles to 30 moles of dispersed calcium carbonate per mole of calcium sulfonate and having a Total Base Number from about 100 to 500. The preferred overbased calcium sulfonate will have from about 10 to 20 moles of dispersed calcium carbonate per mole of calcium sulfonate.

In general, an overbased calcim sulfonate is prepared by reacting a calcium sulfonate (dervied from the reaction of a natural or synthetic sulfonic acid having a molecular weight ranging from about 350 to 600 with hydrated lime) with carbon dioxide at an elevated temperature, 135°-160° F., for an extended time period of several hours and under total reflux conditions. Thereafer the reaction mixture is filtered to recover an approximately 45 percent oil solution of calcium carbonate overbased calcium solution prescribed above. The preparation of this component is fully described in U.S. Pat. No. 3,537,996 and the disclosure of this reference is incorporated herein. This additive is incorporated in a finished lubricant oil in a concentration of 0.2 wt. percent to 6 wt. percent; and more desirably 0.2 wt. percent to 2 wt. percent.

Most desirably, there is employed, additionally as a viscosity index improver, a copolymer of ethylene and propylene containing, in a preferred embodiment 30 to 50 percent propylene having a molecular weight of 20,000 to 50,000. This additive is incorporated in a diluent mineral oil such as 100 E Pale Stock HF or solvent Neutral Oils the proportions of copolymer therein varying, illustratively, from 15 to 20 weight percent. This additive is included in an amount by weight of 5% to 10%.

A further dispersant and viscosity index improving component also contemplated for use in the lubricant oils provided herein is a basic amine-containing addition-type copolymer formed of a plurality of polymerizable ethylenically unsaturated compounds, at least one of which is amino-free and contains from 8 to about 18 carbon atoms in an aliphatic hydrocarbon chain, preferably predominantly straight chain in nature, and one of which, as it exists in the polymer, contains a basic amino nitrogen in the side chain, in an amount by weight of said polymer of 0.05 to 3.5 percent.

It is essential that at least one of the monomeric components employed in making the polymer should introduce an oil-solubilizing or oleophilic structure to insure that the polymer is soluble to the extent of at least 0.1% by weight in naphthenic or paraffinic lubricating oils. In addition, the presence of basic amino groups, either primary, secondary or tertiary may be included optionally to impart additional sludge dispersing properties. Elaborating on the description provided hereinabove, introduction of the basic amino nitrogen structure can be accomplished by the use of at least one monomeric component containing the amino group or by use of a monomer containing a group which is reactive, when present in the polymer, toward ammonia, or primary or secondary non-aromatic amines. These monomers can also contain oleophilic structures that will assist in contributing to the requisite oil solubility. In addition, some of the polymers coming within the scope of this invention can, without sacrificing either oil solubility or dispersing properties, include certain proportions of monomers that do not themselves yield oil soluble polymers.

Desirably, these additional components include about 0.25 to 8.0 weight percent of an oil concentrate containing a polymer of mixed alkyl esters of methacrylic acid having a molecular weight of from about 25,000 to 1,250,000 and preferably where the polymer is to be used as a pour depressant in the range of 25,000 to 50,000. Where its predominant contribution is as a viscosity index improver a molecular weight in excess of 50,000 and within the broader range recited is employed. The foregoing alkyl methacrylate esters are desirably, and usually, mixtures of the foregoing esters wherein the alkyl substituents are straight chained and contain from about 4 to 22 carbon atoms.

Particularly useful pour depressants are the methacrylate esters of $C_4$ to $C_{22}$ primary linear saturated aliphatic alcohols, incorporated in a concentration of up to 33 weight percent in a diluent mineral oil such as 100 E Pale Stock HF.

Further illustrative of these preferred methacrylate-containing polymers are the copolymer of butyl, lauryl, stearyl and dimethaminoethyl methacrylate wherein the butyl, lauryl, stearyl and dimethylamino monomers are incorporated in a weight ratio respectively of 21:53:22:4. It should be understood, additionally, that lauryl methacrylate monomer charged to the polymerization reaction frequently contains about 25 percent to 28 percent by weight of myristyl methacrylate and the stearyl methacrylate monomer includes, by weight, about 32 percent to 44 percent of cetyl methacrylate and possibly up to 16 percent by weight of lower hydrocarbyl-containing methacrylates.

Conventional amine antioxidants are also desirably included in the lubricant compositions of the invention; exemplified by the phenyl naphthylamines, and particularly phenyl beta naphthylamine, phenylene diamine, phenothiazine, diphenylamine and preferably, in many instances, mixed alkylated aromatic amines such as a trialkyl substituted diphenyl amine. Particularly preferred concentrations of antioxidant in the formulation of lube oil concentrates are within the range of about ten (10) to about fifty (50) weight percent. Preferred concentrations of these amines in the finished motor oil compositions are within the range of about 0.1 to about 10 weight percent.

The hydrocarbon mineral oils employed in this invention can be paraffin base, naphthene base, or mixed paraffin-naphthene base distillate or residual oils. The lubricating oil base generally has been subjected to solvent refining to improve its lubricity and viscosity temperature relationship as well as solvent dewaxing to remove waxy components and to improve the pour of the oil. Generally, mineral lubricating oils having an SUS viscosity at 100° F. between 50 and 1000 may be used in the formulation of the improved lubricants of this invention although the viscosity range will usually fall between 70 and 300 SUS at 100° F. A blend of base oils can be employed to provide a suitable base oil for either a single or multigrade motor oil; for example, a naphthenic oil of an SUS viscosity of about 145 at 100° F. and naphthenic lubricating oil of an SUS viscosity of about 100 at 100° F. A desirable base oil blend may be formulated, in addition, from a 65 percent of a furfural-refined, acid-treated clay-contacted, solvent-dewaxed, paraffin base distillate having an SUS at 100° F. of 100; a viscosity index of about 100, a flash point (Cleveland Open Cup Method) of about 385° F. and a pour point below 0° F. or +10° F.; 22 percent of an acid-treated naphthenic base having an SUS at 100° F. of 60, a flash above 300° F. and a pour below −40° F. and 13 percent of a paraffin base residuum which has been propane-deasphalted, solvent-dewaxed and clay-contacted and which has an SUS viscosity at 210° F. of 160, a flash of about 540° F. and a pour below 50° F. This base oil mixture has a flash above 375° F., a pour below 0° F. and a viscosity index of about 93. Viscosity index is measured according to ASTM D 2270; viscosity at 100° F. and 210° F. is determined using ASTM D 445; and pour point data is arrived at utilizing ASTM D 97.

A fully formulated crankcase or automatic transmission lubricant composition for use herein will comprises a base oil blend such as the foregoing in an amount of at least 77 weight percent to about 99 weight percent (e.g. 99.05 weight percent) and preferably about 99 percent (e.g. 89.46 weight percent) and will contain from about 0.5 to 8 weight percent (e.g. 5 weight percent) of an oil concentrate containing about 35 percent by weight of a basic amino nitrogen-containing addition type of alkyl ester of methacrylic acid, that is, butyl, lauryl, stearyl and dimethyl amino-ethyl methacrylates in approximately 21:53:22:4 weight ratios (as described in U.S. patent 2,737,496); from about 0.005 to 0.25 percent by weight of a dimethyl silicone anti-foaming agent; from 0.1 to 3.0 percent of a zinc dialkyl dithiophosphate such as described hereinabove; an overbased calcium sulfonate in an amount by weight based on (calcium content) of 0.2 to 2 wt. percent; an ethylene-propylene copolymer as a viscosity index improver in an amount by weight of 5 percent to 15 percent; a conventional naphthyl amine antioxidant in a concentration of 0.1 to 10 percent; and about 0.1 to 5, and desirably about 2.5, weight percent of an oil concentrate (containing about 44 percent by weight of a naphthenic lubricating oil of an SUS viscosity of about 100 at 100° F.) of mono-(β-hydroxyethyl) alkene thiophosphonate and 0.1 to 10, and preferably 0.1 to 6, weight percent, illustratively, 0.54 weight percent as indicated, above, of lactam of the invention.

The formulations so described are supplied by standard procedures to, illustratively, the crankcase of an internal combustion engine where in operation of the foregoing system and engine, these formulations operate to inhibit sludge formation and corrosion.

The following examples are further illustrative of the invention.

EXAMPLE I

This example illustrates the preparation of the isomeric mixture, 2(3)-polybutenyl-3-(-1'-aminoethyl dihydroimidazolin-2'-yl)-4-phenyl-5-methyl butyrolactam according to the invention.

2(3)-Polybutenyl-3-carboxyl-4-phenyl-5-methyl butyrolactam wherein the polybutenyl group has an average molecular weight of about 1290 and is composed of high molecular weight mono-olefins (85–98 weight percent), the balance, isoparaffins, in an amount of 126 grams (0.06 mole basis theory) was dissolved in 150 ml. of toluene and 6–20 grams (0.06 mole) of diethylene triamine was added. This mixture was refluxed with azeotropic distillation of water over 3 hours at 112° C. to yield 0.6 ml. of water. Solvent and water were removed over a period of six hours at temperatures up to 138° C. causing the collection of a total of 1.4 ml. of water. At this point 50 ml. of xylene was added and refluxed for 7 hours at 165° C., at the end of which period a total of 2.0 ml. of water was collected (theoretical for the N'-aminoethyl dihydroimidazoline derivative is 2.16 ml. of water).

The reaction mixture was cooled, diluted with heptane, filtered and stripped to 180° F. at 10 mm Hg. The yield of product was 134 grams.

Analyses were as follows:

| Test | Calculated | Found |
|---|---|---|
| % Nitrogen: | 2.58 | 2.05 |
| % Basic $HC10_4$ Nitrogen by titration | 1.29 | 0.68 |

The low nitrogen analysis is due, it is believed, to partial conversion of the alkenyl succinic anhydride, (in terms of which the reaction ratio of lactam acid was determined), and possibly to the presence of some 2:1 lactam acid-amine condensation occurring.

EXAMPLE II

This example illustrates the preparation of the imidizazoline substituted lactam of Example I using varying reaction conditions.

2(3)-Polybutenyl-3-carboxy-4-phenyl-5-methyl butyrolactam, wherein the polybutenyl moiety has an average molecular weight of 1290 and is otherwise as described in Example I, was reacted in an amount of 1350 grams (equivalent to 0.645 mole basis theory) with 66.5 grams (0.645 mole) of diethylene triamine in 600 ml. of xylene as solvent. After 16 hours of refluxing at 155° C., 22.6 ml. of water phase was collected (as against a theoretical recovery of 23.2 ml. for the dihydroimidazoline).

The reaction mixture was cooled, diluted, filtered and stripped in the manner described in Example I and the product including, predominantly (i.e. in excess of 60 wt.% and up to 80 wt.% of), the isomeric mixture, 2(3)-polybutenyl-3-(1'-aminoethyl dihydroimidazolin-2'-yl-4-phenyl-5-methyl butyrolactam, was recovered in an amount of 139 grams.

Analysis of the product was as follows:

| Test | Calculated | found |
|---|---|---|
| % N | 2.59 | 1.99 |
| % basic N(by HCl $O_4$ titration) | 1.3 | 0.8 |

EXAMPLE III

This example illustrates the preparation of 1",2"-ethylene-bis-[2(3)-polybutenyl-3-(dihydroimidazolin-2'-yl)-4-phenyl butyrolactam-5].

Thirty grams of ethylenediamine (0.5 mole) and 611 grams of the bis-(lactam acid), 1',2'-ethylene-bis-[2(or 3)-polybutenyl-3-carboxy-4-phenyl butyrolactam-5]equivalent to 0.166 mole, a mole ratio of polyamine to carboxy butyrolactam of about 3:1, respectively (as determined by reference to the alkenyl succinic anhydride employed in preparation of the butyrolactam reactant). were combined, and heated for five hours at 130° C. under a nitrogen atmosphere. Then, about 200 ml. of n-heptane was added (at up to 100° C. and the mixture refluxed to azeotrope out the water of reaction and excess ethylene diamine. The mixture was cooled to room temperature, filtered, and stripped to 130° C./10 mm.Hg. The yield of product including, predominantly, 1",2"-ethylene-bis-[2(3)-polybutenyl-3-(dinhdroimidazolin-2'-yl)-4-phenyl butyrolactam-5]or otherwise expressed, N,N'-ethylene-bis[2(or 3)-polybutenyl-3-(dihydroimidazolin-2'-yl)-4-phenyl butyrolactam]. totalled 604 grams.

Analysis of the product was as follows:

| Test | Calculated | Found |
|---|---|---|
| %N | 1.08 | 0.88 |

EXAMPLE IV

This example illustrates the preparation of 1",6"-hexylene-bis-[2(3)-polybutenyl-3-(dihydroimidazolin-2'-yl)-4-phenyl butyrolactam-5].

The procedure of Example III was repeated substituting 1',6'-hexylene-bis-[2(or 3)-polybutenyl-3-carboxy-4-phenyl butyrolactam-5] for the lactam acid of Example III. The mole ratio of ethylene diamine reacted to lactam acid was in excess of 3:1 (based on incorporated alkenyl succinic anhydride). The product secured included, predominantly, 1", 6"-hexylene-bis-[2(3)-polybutenyl-3-(dihydroimidazolin-2'-yl) phenyl butyrolactam-5].

Analysis was as follows:

| Test | Calculated | Found |
|---|---|---|
| % nitrogen | 1.05 | 0.84 |

EXAMPLE V

This example illustrates the preparation of 2(3)-polybutenyl-3-(dihydroimidazolin-2'yl)-4-phenyl-5-(N,',N'-dimethylaminopropyl-butyrolactam.

The procedure of Example III was repeated substituting 2(3)-polybutenyl-3-carboxy-4-phenyl-5-(N',N'-dimethylaminoethyl)-butyrolactam for the lactam acid of Example III. The mole ratio of ethylene diamine to lactam acid (based on alkenyl succinic anhydride incorporated in the latter) was 3:1. The product secured was predominantly 2(3)-polybutenyl-3-(dihydroimidazolin-2'-yl)-4-phenyl-5-(N',N'-dimethylaminopropyl-butyrolactam, and yield the following analysis:

| Test | Calculated | Found |
|---|---|---|
| % Nitrogen | 1.39 | 1.00 |

EXAMPLE VI

This example illustrates the preparation of 1'',2''-ethylene-bis-[2(3)-polybutenyl-3-(1'[3,6,9-triazanonyl] dihydroimidazolin-2'yl)-4-phenyl butyrolactam-5].

Tetraethylene pentamine in an amount of 2.91 grams (0.0154 mole) and 73.3 grams of the bis-lactam acid, 1',2'-ethylene-bis-[2,(3)-polybutenyl-3-carboxy-4-phenyl butyrolactam-5] equivalent to 0.02 mole of alkenyl succinic anhydride (for a mole ratio of polyamine to lactam acid of 0.77 to 1) were combined and heated to 160° C. under an inert atmosphere of nitrogen, with the removal of distillate as it was formed. After 3 hours at 160° C., the mixture was stripped under 10 mm. Hg vacuum at 160° C. for a further period of 2 hours, after which it was filtered neat at about 120° C. The product, predominantly 1'',2''-ethylene-bis-[2(3)-polybutenyl-3-(1'-[3,6,9-triazanonyl] dihydroimidazolin-2'yl)-4-phenyl butyrolactam-5], manifested the following analysis:

| Test | Calculated | Found |
|---|---|---|
| % Nitrogen | 1.76 | 1.6 |

EXAMPLE VII

The example illustrates the preparation of the dihydro imidazolin-substituted lactam of Example VI employing varying proportions of the reactants recited in this latter example.

The procedure of Example VI was repeated utilizing a mole ratio of polyamine to lactam acid (based on alkenyl succinic anhydride reacted to form the latter) of 0.90 to 1. Essentially the same product as that secured in Example VI, 1'',2''-ethylene-bis-[2(3)-polybutenyl-3-(1'-[3,6,9-triazanonyl] dihydroimidazolin-2'-yl)-4-phenyl butyrolactam-5] was again obtained and manifested the following analysis:

| Test | Calculated | Found |
|---|---|---|
| % Nitgrogen | 2.08 | 1.6 |

EXAMPLE VIII

This example illustrates the preparation of the dihydro imidazolin-substituted lactam, 1'',6''-hexylene-bis-[2(3)-polybutenyl-3-(1'-[3,6,9-triazanonyl] dihydroimidazolin-2'-yl)-4-phenyl butyrolactam-5].

The procedure of Example VI was repeated substituting 1,6-hexylene-bis-[2(3)-polybutenyl-3-carboxy-4-phenyl butyrolactam-5] for the 1',2'-ethylene-bis-lactam acid of Example VI and employing a mole ratio of tetraethylene pentamine of 0.85 to 1 of lactam acid based on alkenyl succinic anhydride determination in this instance. The product mixture including 1'',6''-hexylene-bis-[2(3)-polybutenyl-3-(1'-[3,6,9-triazanonyl] dihydroimidazolin-2'yl)-4-phenyl butyrolactam-5] yielded an analysis as follows:

| Test | Calculated | Found |
|---|---|---|
| % Nitrogen | 1.84 | 1.6 |

It will be evident that whereas Examples I and II utilized inert organic solvent, the foregoing Examples III to VIII inclusive utilized no solvent.

EXAMPLE IX

The example illustrates the preparation of 2(3)-polybutenyl-3-[1'-(3,6,9-triazanonyl)-imidazolin-2'-yl]-4-phenyl-5-methyl butyrolactam.

To 1930 grams (equivalent to 0.96 mole) of 2(3)-polybutenyl-3-carboxy-4-phenyl-5-methyl butyrolactam was added 181 grams (0.96 mole) of the tetraethylene pentamine in 400 ml. of xylene. After refluxing for 19 hours at 30° to 177° C. with removel of the water of reaction, the product was diluted with 1500 ml. of n-heptane, filtered and stripped to 150° C. at 15 mm. Hg pressure.

A yield of product amounting to 2081 grams was secured. This product was redissolved in 6000 ml. of heptane and then extracted with two separate 500 ml. portions, of methanol. The heptane raffinate was then stripped to 150° C. at 15 mm. pressure. The product as recovered included predominantly 2(3)-polybutenyl-3-[1'-(3,6,9-triazanonyl)-dihydro imidazolin-2'yl]-4-phenyl-5-methyl butyrolactam. Recovery in the extraction was 90 weight percent. The analysis secured was as follows:

| | | Found | |
|---|---|---|---|
| Test | Calculated | Before Extraction | After Extraction |
| %N | 3.88 | 3.96 | 2.06 |
| TBN | 104 | 82 | 39 |

EXAMPLE X

This example illustrates the preparation of 2(3)-polybutenyl-3-[1'-(3,6,9-triazanonyl)-dihydro imidazolin-2'-yl]-4-phenyl-5-(N',N'-dimethylaminoethyl) butyrolactam.

Equimolar portions of 2(3)-polybutenyl-3-carboxy-4-phenyl-5-(N',N'-dimethylaminoethyl) butyrolactam and tetraethylenepentamine were reacted and treated in a manner similar to that recited in Example I. The resulting product, including, predominantly, 2(3)-polybutenyl-3-[1'-(3,6,9-triazanonyl)-dihydro imidazolin-2'-yl]-4-phenyl-5-(N',N'-dimethylaminoethyl) butyrolactam, evidenced the following analysis:

| Test | Found | Calculated |
|---|---|---|
| % Nitrogen | 3.1 | 3.45 |

EXAMPLE XI

This example illustrates the preparation of 2(3)-tetrapropenyl-3-[1'-aminoethyl(or 3-azapropyl)-dihydro imidazolin-2'-yl]-4-phenyl-5-methyl butyrolactam.

Equimolar proportions of 2(3)-tetrapropenyl-3-carboxy-4-phenyl-5-methyl butyrolactam and diethylenetriamine was reacted and treated in a manner similar to that recited in Example I. The resulting product, including predominantly 2(3)-tetrapropenyl-3-(1'-aminoethyl-dihydro imidazolin-2'-yl)-4-phenyl-5-methyl butyrolactam, was recovered. The analysis was as follows:

| Test | Calculated | Found |
|---|---|---|
| % Nitrogen | 11.4 | 8.8 |

The polybutenyl substituent of the reactant carboxy butyrolactams or amine derivatives secured therefrom refer, throughout the example, to the radical derived from polybutenes composed predominantly, that is, normally from 85 to 98 weight percent, of high molecular weight monoolefins, the remainder being isoparaffins, and specifically the polybutene having an average molecular weight of 1290 and marketed by AMOCO under the trade name INDOPOL H-300.

The dodecenyl or tetrapropenyl substituent recited as the alkenyl radical in the 2 and 3 positions of the lactam reactants and products, is, like the polybutenyl substituents or other hydrocarbyl groups present referred to elsewhere herein, a linear or branch-chain moiety.

The structure of the products prepared in each of the foregoing Examples I to XI has been confirmed by infra-red spectrometry, NMR and related analytical techniques.

EXAMPLE XII

This example illustrates the application of the compounds of Example III to VIII inclusive as dispersants for use in lubricant oils.

The butyrolactam amine derivatives of the invention identified in Table II appearing hereinafter were incorporated in the amounts indicated in the table in conventional lubricant oil compositions also recited therein and subjected to rust and detergency tests, the results of which are also recited in Table II.

The dihydro imidazolinyl lactam additive prepared in each of the Examples indicated in Table II were separately blended in a concentration of 7.2 percent by weight (50 percent concentrate in diluent oil) in 10W-40 grade motor oil formulation containing, in addition: 0.23 percent of nominal 18:1 overbased calcium sulfonate formed of a colloidal mixture of amorphous calcium carbonate/calcium hydroxide in a mole ratio respectively of 85 to 15, dispersed by a calcium alkarylsulfonate, the foregoing calcium sulfonate formulation being diluted in a 100 E Pale HF carrier oil to a weight ratio of 40 percent carrier oil and 60 percent calcium sulfonate; 0.15 percent of zinc dialkyldithiophosphate prepared by reaction of a mixture of $C_3$ to $C_7$ alcohols and $P_2S_5$ and the reaction product reacted with zinc oxide; 0.25 percent of a mixed alkylated trisubstituted diphenylamine Vanderbilt (VANLUBE NA); 0.5 percent of a formulation containing 33 percent of a copolymer prepared by polymerization of synthetic lauryl methacrylate and stearyl methacrylate in a weight ratio of 75 percent to 25 percent respectively of monomers charged; and 67 percent of a mineral oil 145 P Pale Tubine Stock HF and 100 E Pale Stock HF; together with 10 percent of an ethylene-proylene copolymer of 20,000 to 50,000 molecular weight containing 30 to 50 mole percent propylene in a 100 E Pale Stock mineral oil in a weight ration of copolymer to mineral oil of 13 percent to 87 percent; and all of the foregoing incorporated in a SNO-7 base oil. The foregoing lubricant oil formulation is referred in the absence of the additive of the invention (or the alkenyl succinimide use as a control) as the "base blend."

The bench test, hereinafter referred to as the "Bench Varnish Test" used to measure the dispersancy of the dihydro imidazolidinyl lactams of the invention involves mixing, and shaking for this purpose, a sample of the test oil composed of the base blend, a minor but identical amount, in each instance, of the bottoms from a topped gasoline oil and the identical number of drops, in each instance, of a silicone anti-foamant. The resulting test mixture is placed in a test tube which is immersed in an oil bath maintained at an elevated temperature. A mixture of $NO_2$ and air is bubbled through the test mixture for a like period of time in each instance and is then air-blown to flush out the $NO_2$/air mixture and the degraded oil is then utilized in the "Bench Low Temperature Deposits Test" in which a mixture of the foregoing test oil, synthetic hydrocarbon blowby and diluent oil are heated to an elevated temperature and maintained at this temperature for a selected period of time identical in each instance. After heating, additional diluent oil is added to the test sample prior to determining the turbidity of the mixture.

The turbidity of the oil is determined in a Lumetron Colorimeter. A low turbidity reading, i.e., from 0–10 percent turbidity, indicates an oil having a good low-temperature deposits performance. Oils having a high turbidity reading, i.e., 40 to 100 percent, is indicative of an oil with poor low-temperature deposits characteristics. Moderate dispersancy is evidenced by a reading of 10 to 40, with a reading of less than 10 evidencing an oil having very desirably dispersancy properties.

In Table II, the base blend incorporating the lactams of Examples III to VIII were in all instances, save one, tested by means of the Bench Low Temperature Deposits Dispersancy Test without first being degraded. In the case of the imidazoline lactam of Example IV, the base blend and additive was tested not only without degradation of the test oil, but with degradation pursuant to the Bench Varnish Test. In each instance, a control ("control") composed of the same base blend and a known anti-corrosive dispersant, an alkenyl succinimide derived from reaction of tetraethylenepentamine and polyisobutylenesuccinic anhydride having a molecular weight of about 1300, in a molar ratio of 0.9 to 1 of amine of anhydride, was subjected to the same test procedures and the results of these tests also appear in Table II.

The control additive (formulated before addition to the base blend in a 50% concentration of mineral oil) was employed in the same amount as the additives of the invention.

The results of Table II thus show not only the relative effective dispersancy of the additives of the invention in new lubricant oil compositions, but the effectiveness of the dispersant under the arduous conditions of actual use simulated by the Bench Varnish Test. The unit values of the test procedures incorporate a margin of error of ±2.

Table II

| Imidazolinyl Lactam of Example No. | Base Blend + Imidazolinyl lactam of Indicated Example | Control |
|---|---|---|
| III | 24.0 | 4.0 |
| IV | 31.0 | 4.0 |

Table II-continued

| Imidazolinyl Lactam of Example No. | Base Blend + Imidazolinyl lactam of Indicated Example | Control |
|---|---|---|
| V | 43.0 | 4.0 |
| VI | 5.5 | 3.5 |
| VI* | 4.5 | 16.0 |
| VII | 7.0 | 3.5 |
| VIII | 12.5 | 4.0 |

*After degradation pursuant to procedure of Bench Varnish Test.

It will be evident from the foregoing Table that while all of the additives of the invention manifested dispersant properties, the novel bis-lactam additives in which the imidazoline substituent contained a 3,6,9-triazanonyl moiety, provided particularly useful dispersants for use in lubricant compositions without regard for their effectiveness as corrosion inhibitors. It is evident, too, that although a formulation such as the control, having a satisfactorily low turbidity reading before being subjected to the rigorously degrading environment represented by the Bench Varnish Test manifested a dramatic increase in its turbidity reading after such treatment, while, in contrast, the formulation incorporating the 1'',2''-ethylene-bis-[2,(3)-polybutenyl-3-(1'-[3,6,9-triazanonyl]dihydroimidazolin-2'yl)-4-phenyl butyrolactam-5] of Example VI remained essentially unchanged.

EXAMPLE XIII

This example illustrates the application of the butyrolactams of Example I as dispersants and corrosion inhibitors in lubricant compositions.

The lactam of Example I, 2(3)-polybutenyl-3-(1'-aminoethyl dihydroimidazolin-2'-yl)-4-phenyl-5-methyl-butyrolactam, was incorporated in the conventional lubricant oil composition or base blend of Table III appearing hereinbelow. The effective dispersancy and corrosion inhibition of the foregoing butyrolactam in this base blend was compared with the base blend incorporating the standard succinimide additive utilized in Example XII and the base blend of this example without any equivalent additive. These test samples were subjected to the Bench Low Temperature Deposits Test described in Example XII and the "Bench Rust Test" described hereinbelow. The results of these tests are recited in Table III.

The "Bench Rust Test" involves placing a section of a push rod and a sample of the test oil, e.g., the base blend and additive of the invention in the concentrations indicated, in a vessel which is, in turn, placed in a heated bath to maintain the temperature of the test oil at a moderately elevated temperature. A nitrogen dioxide-air stream and an air stream saturated with water vapor are passed through the test oil for a fixed period of time. After the first hour of the test, small amounts of high-lead, high-sulfur fuel are also added to the test oil at regular intervals. On completion of the test, the push rod is removed from test oil, washed with solvent to remove oil and varnish, and then visually rated for rust using the CRC rust rating scale (a scale from 10 to 1, with 10 being clean); a value of 8 to 10 representing a clearly acceptable corrosion inhibition.

Table III

| Composition (in SNO-7) | Run 1 | Run 2 | Run 3 |
|---|---|---|---|
| Overbased Ca sulfonate-% Ca.* | 0.23 | 0.23 | 0.23 |
| Zinc alkyldithiophosphate prepared mixed isopropanol and $P_2S_5$-% Zn | 0.15 | 0.15 | 0.15 |
| Mixed alkylated trisubstituted diphenyl amine.-(Vanlube NA),% wt. | 0.25 | 0.25 | 2.25 |
| Ethylene-propylene copolymer of 20,000-50,000 molecular weight containing 30 to 35 mole % propylene in a mineral oil pale stock, % wt. | 10.0 | 10.0 | 10.0 |
| Copolymer of synthetic lauryl methacrylate and stearyl methacrylate in a weight ratio of 75:25 respectively on the basis of monomer charged and incorporated in a mineral pale stock, % wt. | 0.5 | 0.5 | 0.5 |
| 2(3)-polybutenyl-3(1'-aminoethyldihydroimidazolin-2'-yl)-4-phenyl-5-methyl butyrolactam | 0 | 0.5 | 0 |
| Standard alkenyl succinimide of Example | 0 | 0 | 0.5 |
| Test Procedures | | | |
| Bench Low Temperature Deposits Dispersancy Test | 90.0 | 14.5 | 2.5 |
| Bench Rust Test | 6.5 | 8.2 | 7.0 |

*Contains 10 to 20 moles of dispersed calcium, primarily as the carbonate, per mole of calcium sulfonate.

It will be evident from the foregoing test results that the butyrolactam of the invention imparts a material dispersancy and rust inhibition to a standard lubricant oil composition.

EXAMPLE XIV

This example illustrates the dispersancy and rust inhibition properties of the imidazoline lactam of Example IX.

The base blend of Example XIII was tested for dispersancy alone and with 5 weight percent of the product of Example IX, 2(3)-polybutenyl-3-[1'-(3,6,9-triazanonyl)-imidazolin-2'-yl]-4-phenyl-5-methyl butyrolactam, before and after extraction with methanol using the Bench Low Temperature Dispersancy Test and Bench Rust Test described in Example XII and XIII respectively.

The composition and test results are reported in Table IV as follows:

Table IV

| Composition | Run 1 | Run 2 | Run 3 |
|---|---|---|---|
| Base blend | 100% | 95% | 95% |
| Example IX imidazolinyl butryolactam, before extraction with methanol | 0 | 5% | 0 |
| after extraction with methanol | 0 | 0 | 5% |
| Test Procedure: | | | |
| Bench Low Temperature Dispersancy Test: | 94 | * | 2.0 |
| Bench Rust Test: | 8.3 | 8.4 | 8.2 |

*Unsuitable precipitate caused by apparent contaminant in test procedure.

As the foregoing Table makes clear, the butyrolactam product did not adversely affect the rust inhibition properties of the base blend, but enhanced significantly the dispersancy of the base blend, at least, when extracted with methanol.

It will be evident that β-lactam amides, tetrahydro pyrimidines and dihydro imidazolines corresponding to the β-lactam acids described in the present applicant's copending application entitled "Lactam Carboxylic Acids; Their Method of Preparation and Use" filed on even date herewith and otherwise corresponding to the butyrolactams hereof after reaction with the polyamine reactants described herein, may also be formed in accordance with the process of this invention.

It will be evident, too, that the terms and expressions which have been employed are used as terms of description and not of limitation. There is no intention in the use of such terms and expressions of excluding equivalents of the features shown and described or portions thereof, and it is recognized that various modifications are possible within the scoe of the invention claimed.

What is claimed is:

1. A substituted butyrolactam of the formula:

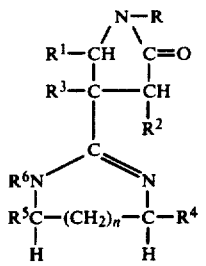

wherein R is a hydrocarbyl radical of from 1 to 12 carbon atoms, an N-mono-or N,N-di-hydrocarbyl substituted aminoalkylidene group wherein each hydrocarbyl moiety contains from 1 to 12 carbon atoms, or an N-butyrolactam radical $R^1$ is a hydrocarbyl radical of from 1 to 20 carbon atoms;

each of $R^2$ and $R^3$ is a hydrogen atom or a hydrocarbyl radical of from 1 to 500 carbon atoms, provided that only one of $R^2$ and $R^3$ is hydrogen; and only one of $R^2$ and $R^3$ is hydrocarbyl;

each of $R^4$ and $R^5$ is hydrogen or a hydrocarbyl radical of from 1 to 25 carbon atoms;

$R^6$ is hydrogen or a hydrocarbyl radical of from 1 to 25 carbon atoms or an amino alkyl or poly (azaalkyl) radical; and n has a value of 0 to 1 inclusive.

2. A substituted butyrolactam as claimed in claim 1, wherein $R^3$ is an alkenyl radical of from 1 to 500 carbon atoms.

3. A substituted butyrolactam as claimed in claim 1, wherein $R^2$ is an alkenyl radical of from 1 to 500 carbon atoms.

4. A substituted butyrolactam as claimed in claim 1, wherein $R^1$ is phenyl.

5. A substituted butyrolactam as claimed in claim 1, wherein each of $R^4$ and $R^5$ is a hydrogen atom.

6. A substituted butyrolactam as claimed in claim 1, wherein $R^6$ is an aminoalkyl radical in which said alkyl group contains from 1 to 6 carbon atoms.

7. A substituted butyrolactam as claimed in claim 1, wherein $R^6$ is a poly(azaalkyl) radical in which each alkyl moiety contains from 2 to 6 carbon atoms and said azaalkyl moieties recur from 1 to 10 times.

8. A substituted butyrolactam as claimed in claim 1, wherein R is an N-(butyrolactam) alkyl radical wherein said N-(butyrolactam) is a recurring unit.

9. A substituted butyrolactam as claimed in claim 1, wherein R is a lower alkyl group of from 1 to 6 carbon atoms.

10. A substituted butyrolactam as claimed in claim 1, wherein R is methyl.

11. A substituted butyrolactam as claimed in claim 1, wherein R is an dialkylaminoalkyl substituent.

12. A substituted butyrolactam as claimed in claim 1, wherein R is N,N-dimethylaminopropyl.

13. A substituted butyrolactam as claimed in claim 3, wherein $R^2$ is a polybutenyl radical.

14. A substituted butyrolactam as claimed in claim 3, wherein $R^2$ is a tetrapropenyl radical.

15. A substituted butyrolactam as claimed in claim 2, wherein $R^3$ is a polybutenyl radical.

16. A substituted butyrolactam as claimed in claim 2, wherein $R^3$ is a tetrapropenyl radical.

17. A substituted butyrolactam as claimed in claim 1, wherein n has a value of 0.

18. A substituted butyrolactam as claimed in claim 3, wherein said butyrolactam is 2-polybutenyl-3-(1'-aminoethyl dihydroimidazolin-2'yl)-4-phenyl-5-methyl butyrolactam.

19. A substituted butyrolactam as claimed in claim 3, wherein said butyrolactam is 1'',2''-ethylene-bis-[2-polybutenyl-3-(dihydroimidazolin-2'-yl)-4-phenyl butyrolactam-5].

20. A substituted butyrolactam as claimed in claim 3, wherein said butyrolactam is 1'',6''-hexylene-bis-[2-polybutenyl-3-(dihydroimidazolin-2'yl)-4-phenybutyrolactam-5].

21. A substituted butyrolactam as claimed in claim 3, wherein said butyrolactam is 2-polybutenyl-3-(dihydroimidazolin-2'-yl)-4-phenyl-5-(N,N-dimethylaminoethyl)butyrolactam.

22. A substituted butyrolactam as claimed in claim 3, wherein said butyrolactam is 1'',2''-ethylene-bis-[2-polybutenyl-3-(1'-[3,6,9-triazanonyl]-dihydroimidazolin-2'-yl)-4-phenyl butyrolactam-5].

23. A substituted butyrolactam as claimed in claim 3, wherein said butyrolactam is 1'',6''-hexylene-bis-[2-polybutenyl-3(1'-[3,6,9-triazanonyl]-dihydroimidazolin-2'-yl)-4-phenyl butyrolactam-5].

24. A substituted butyrolactam as claimed in claim 3, wherein said butyrolactam is 2-polybutenyl-3[1'-(3,6,9-triazanonyl)-dihydroimidazolin-2'-yl]-4-phenyl-5-methyl butyrolactam.

25. A substituted butyrolactam as claimed in claim 3, wherein said butyrolactam is 2-polybutenyl-3-[1'-(3,6,9-triazanonyl)-dihydroimidazolin-2'-yl]-4-phenyl-5-(N,N-dimethylaminoethyl)butyrolactam.

26. A substituted butyrolactam as claimed in claim 3, wherein said butyrolactam is 2-tetrapropenyl-3-[1'-aminoethyl-dihydroimidazolin-2'-yl]-4-phenyl-5-methylbutyrolactam.

27. A process that comprises reacting a carboxy butyrolactam of the formula:

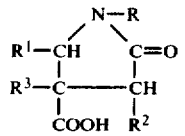

wherein R is a hydrocaarbyl radical of from 1 to 12 carbon atoms, an N-mono-or N,N-di-hydrocarbyl-substituted aminoalkylidene group wherein each hydrocarbyl moiety contains from 1 to 12 carbon atoms; or an N-(3-carboxy-butyrolactam) radica $R^1$ is a hydrocarbyl radical of from 1 to 20 carbon atoms; and each of $R^2$ and $R^3$ is a hydrogen atom or a hydrocarbyl radical of from 1 to 500 carbon atoms, provided that only one of $R^2$ and $R^3$ is hydrogen, and only one of $R^2$ and $R^3$ is hydrocarbyl;

with a polyamine of the formula:

$$H(NHC_rH_{2r})qNH-(W)$$

wherein r is an integer of from 2 to 3 inclusive; q is an integer of from 1 to 10, and W is a hydrocarbyl, aminoalkyl or poly(azaalkyl) radical; at a temperature within the range of 25° C. and 250° C.

28. A process as claimed in claim 27, wherein said carboxy butyrolactam and said polyamine are reacted at a temperature of from 60° C. to 200° C.

29. A process as claimed in claim 28, wherein said carboxy butyrolactam and said polyamide are reacted at a temperature of from 100° C. to 180° C. in an insert atmosphere.

30. A process as claimed in claim 29, wherein said process takes place at ambient pressure.

31. A process as claimed in claim 27, wherein said carboxy butyrolactam is 2-polybutenyl-3-carboxy-4-phenyl-5-methybutyrolactam; said polybutenyl moiety having an average molecular weight of from 1000 to 1500; and said polyamine is diethylenetriamine.

32. A process as claimed in claim 27, wherein said carboxybutyrolactam is 2-polybutenyl-3-carboxy-4-phenyl-5-methybutyrolactam; said polybutenymoiety having an average molecular weight of from 1000 to 1500; and said polyamine is tetraethylenepentamine.

33. A process as claimed in claim 27, wherein said carboxy butyrolactam is 2-polybutenyl-3-carboxy-4-phenyl-5-methybutyrolactam, said polybutenyl moiety having an average molecular weight of from 1000 to 1500; and said polyamine is tetraethylene pentamine.

34. A process as claimed in claim 27, wherein said carboxy butyrolactam is 2-polybutenyl-3-carboxy-4-phenyl-5-(N,N-dimethylaminoethyl)-butyrolactam, said polybutenyl moiety having an average molecular weight of from 1000 to 1500; and said polyamine is tetraethylene pentamine.

35. A process as claimed in claim 27, wherein said carboxy butyrolactam is 2-tetrapropenyl-3-carboxy-4-phenyl-5-methybutyrolactam; and said polyamine is diethylenetriamine.

36. A lubricant oil composition comprising:

an oil of lubricating viscosity, and an effective dispersant amount of a butyrolactam of the formula:

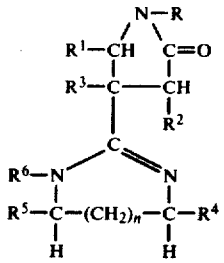

wherein R is a hydrocarbyl radical of from 1 to 12 carbon atoms;

an N-mono-or N,N-di-hydrocarbyl substituted aminoalkylidene group wherein each hydrocarbyl moiety contains from 1 to 12 carbon atoms;

or an N-butyrolactam radical $R^1$ is a hydrocarbyl radical of from 1 to 20 carbon atoms;

each of $R^2$ and $R^3$ is a hydrogen atom or a hydrocarbyl radical of from 1 to 500 carbon atoms, provided that only one of $R^2$ and $R^3$ is hydrogen; and only one of $R^2$ and $R^3$ is hydrocarbyl;

each of $R^4$ and $R^5$ is hydrogen or a hydrocarbyl radical of from 1 to 25 carbon atoms;

$R^6$ is a hydrocarbyl radical of from 1 to 25 carbon atoms or an amino alkyl or poly(azaalkyl) radical; and n has a value of 0 to 1 inclusive.

37. A lubricant oil composition as claimed in claim 36, wherein the hydrocarbyl radical represented by $R^2$ or $R^3$ is an alkenyl radical of from 1 to 500 carbon atoms.

38. A lubricant oil composition as claimed in claim 37, wherein said alkenyl radical contains from 10 to 300 carbon atoms.

39. A lubricant oil composition as claimed in claim 36, wherein each of $R^4$ and $R^5$ is a hydrogen atom.

40. A lubricant oil composition as claimed in claim 36, wherein $R^6$ is an aminoalkyl radical in which said alkyl moiety contains from 1 to 6 carbon atoms.

41. A lubricant oil composition as claimed in claim 36, wherein $R^6$ is a poly(azaalkyl) radical in which each alkyl moiety contains from 2 to 6 carbon atoms and said azaalkyl moieties recur from 1 to 10 times.

42. A lubricant oil composition as claimed in claim 36, wherein R is an N-(butyrolactam) alkyl radical in which said N-(butyrolactam) is a recurring unit.

43. A lubricant oil composition as claimed in claim 36, wherein R is a lower alkyl group of from 1 to 6 carbon atoms.

44. A lubricant oil composition as claimed in claim 36, wherein R is methyl.

45. A lubricant oil composition as claimed in claim 36, wherein $R^1$ is an N,N-dialkylaminoalkyl substituent.

46. A lubricant oil composition as claimed in claim 36, wherein R is N,N-dimethylaminoethyl.

47. A lubricant oil composition as claimed in claim 36, wherein R is an N-(butyrolactam) alkyl moiety identical to that to which R is attached and said alkyl moiety contains from 1 to 7 carbon atoms.

48. A lubricant oil composition as claimed in claim 36, wherein $R^2$ is a polybutenyl radical.

49. A lubricant oil composition as claimed in claim 36, wherein $R^2$ is a tetrapropenyl radical.

50. A lubricant oil composition as claimed in claim 36, wherein $R^3$ is a polybutenyl radical.

51. A lubricant oil composition as claimed in claim 36, wherein $R^3$ is a tetrapropenyl radical 52. A lubricant oil composition as claimed in claim 36, wherein said butyrolactam is 2-polybutenyl-3-(1'-aminoethyl dihydroimidazolin-2'-yl)-4-phenyl-5-methyl butyrolactam.

53. A lubricant oil composition as claimed in claim 36, wherein said butyrolactam is isomeric 2(3)-alkenyl-3-(1'-[3,6,9-triazanonyl]imidazolin-2'-yl)-4-phenyl-5-methyl butyrolactam.

54. A method for operating an engine that comprises supplying to the crankcase thereof a lubricant oil, that comprises an oil of lubricating viscosity and from 0.1 to 10 percent by weight of a butyrolactam of the formula;

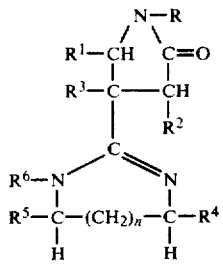

wherein R is a hydrcarbyl radical of from 1 to 12 carbon atoms;

an N-mono-or N,N-dihydrocarbyl substituted aminoalkylidene group wherein each hydrocarbyl moiety contains from 1 to 12 carbon atoms;

or an N-butyrolactam radical

R is a hydrocarbyl radical of from 1 to 20 carbon atoms;

each of $R^2$ and $R^3$ is a hydrogen atom or a hydrocarbyl radical of from 1 to 500 carbon atoms, provided that only one of $R^2$ and $R^3$ is hydrogen; and only one of $R^2$ and $R^3$ is hydrocarbyl;

each of $R^4$ and $R^5$ is hydrogen or a hydrcarbyl radical of from 1 to 25 carbon atoms;

$R^6$ is a hydrocarbyl radical of from 1 to 25 carbon atoms, an amino alkyl or polyazaalkyl radical; and n has a value of 0 to 1 inclusive.

55. A method as claimed in claim 54, wherein said butyrolactam is 2(3)-alkenyl-3-(1'-aminoethyl dihydroimidazolin-2'-yl)-4-phenyl-5-methyl butyrolactam, and wherein said alkenyl moiety contains from 10 to 300 carbon atoms.

56. A method as claimed in claim 54, wherein said butyrolactam is 1'',2''-ethylene-bis-[2(3)-alkenyl-3-(dihydroimidazolin-2'-yl)-4-phenyl butyrolactam-5]; wherein said alkenyl moiety contains from 10 to 300 carbon atoms.

57. A method as claimed in claim 54, wherein said butyrolactam is 1'',6''-hexylene-bis-[2(3)-alkenyl-3-(dihydroimidazolin-2'-yl)-4-phenyl butyrolactam-5], and said alkenyl moiety contains from 10 to 300 carbon atoms.

58. A method as claimed in claim 54, wherein said butyrolactam is 2(3)-alkenyl-3-(dihydroimidazolin-2'-yl)-4-phenyl-5-(N',N'-dimethylaminoethyl)-butyrolactam, and said alkenyl moiety contains from 10 to 300 carbon atoms.

59. A method as claimed in claim 54, wherein said butyrolactam is 1'',2''-ethylene-bis-[2(3)-alkenyl-3-(1'-[3,6,9-triazanonyl]-dihydroimidazolin-2'-yl)-4-phenyl butyrolactam-5]; and said alkenyl moiety contains from 10 to 300 carbon atoms.

60. A method as claimed in claim 54, wherein said butyrolactam is 1'',6''-hexylene-bis-[2(3)-alkenyl-3-(1'-[3,6,9-triazanonyl]-dihydroimidazolin-2'-yl)-4-phenyl butyrolactam-5], and said alkenyl moiety contains from 10 to 300 carbon atoms.

61. A method as claimed in claim 54, wherein said butyrolactam is 2(3)-alkenyl-3-[1'-(3,6,9-triazanonyl)-dihydroimidazolin-2'-yl]-4-phenyl-5-methyl butyrolactam; and said alkenyl moiety contains from 10 to 300 carbon atoms.

62. A method as claimed in claim 54, wherein said butyrolactam is 2(3)-alkenyl-3-[1'-(3,6,9-triazanonyl)-dihydroimidazolin-2'-yl]-4-phenyl-5-(N,N-dimethylaminoethyl) butyrolactam and said alkenyl moiety contains from 10 to 300 carbon atoms.

63. A method as claimed in claim 54, wherein said butyrolactam is 2(3)-tetrapropenyl-3-[1'-aminoethyl dihydroimidazolin-2'-yl]-4-phenyl-5-methyl butyrolactam.

* * * * *